United States Patent [19]

Mehne

[11] 4,218,193

[45] Aug. 19, 1980

[54] HYDRAULIC PUMP DRIVE

[75] Inventor: John T. Mehne, Muskegon, Mich.

[73] Assignee: Teledyne Industries, Inc., Los Angeles, Calif.

[21] Appl. No.: 674,778

[22] Filed: Apr. 8, 1976

[51] Int. Cl.[2] ..... F24B 17/00; F16H 37/00

[52] U.S. Cl. ..... 417/364; 123/198 C

[58] Field of Search ..... 417/364; 184/103 R, 184/6.28; 123/198 C

[56] References Cited

U.S. PATENT DOCUMENTS

| | | | |
|---|---|---|---|
| 2,068,377 | 1/1937 | Crittenden | 184/6.28 |
| 3,186,344 | 6/1965 | Hogeman | 417/364 |
| 3,643,642 | 2/1972 | Jones | 123/198 C |
| 3,781,137 | 12/1973 | Engstrom | 417/364 |

*Primary Examiner*—Richard E. Gluck

*Attorney, Agent, or Firm*—Gifford, VanOphem, Sheridan & Sprinkle

[57] ABSTRACT

A hydraulic pump drive for use in conjunction with an engine having a drive shaft in which the pump drive is adapted to be secured to the rear end of the engine. The pump drive comprises a housing secured to the engine and having an aperture for receiving the drive shaft therethrough. A first gear is rotatably carried within the housing and is coaxially secured to the drive shaft. A second gear is also rotatably carried within the housing in a spaced and parallel relationship to the first gear and meshingly engages the first gear. The second gear is coupled to a hydraulic pump so that the drive shaft rotatably drives the hydraulic pump via the first and second gears.

6 Claims, 2 Drawing Figures

HYDRAULIC PUMP DRIVE

BACKGROUND OF THE INVENTION

I. Field of the Invention

The present invention relates generally to hydraulic pump drives and more particularly to a hydraulic pump drive adapted to be secured to the rear of the engine.

II. Description of the Prior Art

The use of hydraulic pumps in conjunction with internal combustion engines, or the like, has become more and more prevalent in modern times to provide power for accessories or as an assist for brakes and steering for automobiles for instance. Such hydraulic pumps are driven by the engine and for this purpose a hydraulic pump drive rotatably couples the hydraulic pump to the engine.

These previously known hydraulic pumps and hydraulic pump drives have been typically mounted at the front of the engine. Only so many pumps can be mounted to the front of the engine, however, and as the number of pumps in use on an engine increases some means will have to be provided to mount at least some of the pumps to the rear of the engine.

Also, hydraulic pumps and their associated drive occupy a great deal of space at the forward end of the engine. In modern automobiles and other vehicles, engine compartment space at the front of the engine is limited so that elimination of the hydraulic pump and its drive from the front of the engine would be an important advantage for this reason as well.

Further, with hydraulic pumps and their drives at the forward end of the engine, they are exposed to damage in the event of a collision or the like. The repair or replacement of either the hydraulic pump or its drive is not only expensive, but also time consuming. Moreover, damage to the hydraulic pump may render the vehicle inoperable. Thus again it would be advantageous to place at least the more important and more expensive hydraulic pumps at the rear of the engine.

SUMMARY OF THE PRESENT INVENTION

The present invention provides a hydraulic pump drive which is mounted at the rear end of the engine.

The hydraulic pump drive of the present invention is of simple construction and comprises a housing secured to the rear end of the engine and adapted to receive the engine drive shaft therethrough. A first gear is rotatably mounted in the housing and is coaxially secured to the drive shaft. A second gear is also rotatably carried within the housing so that its axis is parallel to but spaced from the engine drive shaft and the second gear meshingly engages the first gear. The hydraulic pump is secured to the pump drive housing and is rotatably driven by the second gear.

As will become hereinafter more apparent, the pump drive of the present invention is of relatively narrow construction and, in addition, includes a mounting flange for a clutch, torque converter or the like. Moreover, the pump drive housing includes a mounting portion particularly adapted for a starter motor.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
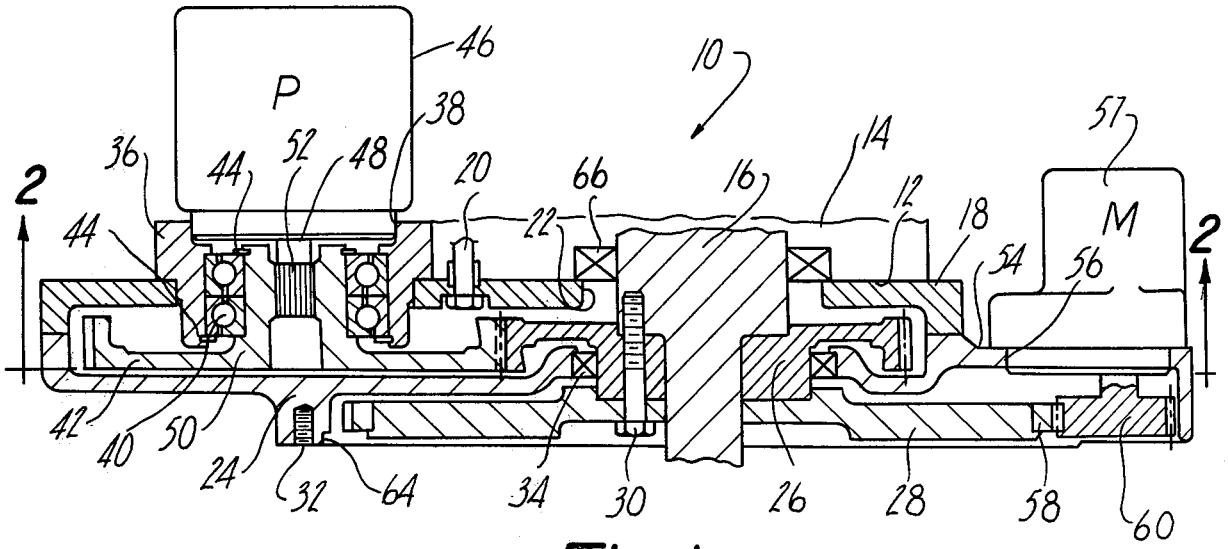
FIG. 1 is a cross-sectional view showing the hydraulic pump drive of the present invention.

With reference to the drawing, the hydraulic pump drive 10 of the present invention is thereshown as being secured to the rear 12 of an engine 14. The engine 14 is preferably an internal combustion engine but in any case rotatably drives a drive shaft 16.

The pump drive 10 further includes a mounting plate 18 secured to the rear 12 of the engine 14 in any conventional manner such as by bolts 20. An aperture 22 in the mounting plate 18 registers with the drive shaft 16 and cover housing 24 in turn is secured over and onto the mounting plate 18.

A spur gear 26 and a fly wheel 28 are respectively coaxially secured to the drive shaft 16 by bolt members 30 or the like so that the spur gear 26 is contained substantially within the housing 24 while the fly wheel 28 is exposed at the rearward end 32 of the pump drive 10. An annular oil seal 34 is provided between the cover housing 24 and the hub of the spur gear 26 in order to retain oil within the housing 24 as will be hereinafter described in greater detail.

A bearing adapter 36 having a mounting recess 38 is secured to the mounting plate 18 at a point radially spaced from the drive shaft 16. The bearing adapter 36 rotatably supports a second spur gear 42 by bearings 40. Snap rings 44 axially retain the spur gear 42 to the bearing adapter 36.

The spur gear 42 meshingly engages the first spur gear 26 so that a rotation of the first spur gear 26 rotatably drives the second spur gear 42.

A hydraulic pump 46 having a driven shaft 48, the rotation of which drives the pump 46, is mounted within the recess 38 on the bearing adapter 36. Although any conventional means may be used, preferably the shaft 48 is splined into the hub 50 of the second spur gear 42 as shown at 52. In this manner, the second spur gear 42 rotatably drives the hydraulic pump 46.

Preferably the housing 24 includes a mounting flange 54 with an aperture 56 radially spaced from the drive shaft 16 for mounting a starter motor 57 having a drive gear 60 thereto. A ring gear 58 may, for example, be formed around the outer periphery of the fly wheel 28 for selective engagement with the drive gear 60 of the starter motor 57.

Preferably an annular abutment surface 64 is provided coaxially with the engine shaft 16 on the rear surface 32 of the cover housing 24. The annular surface 64 provides a convenient mounting pocket for a clutch, a torque convertor or the like.

Although any conventional lubrication system may be used to lubricate the hydraulic pump drive 10 of the present invention, preferably the oil flow through the rear main engine bearing 66 provides the lubrication for the drive 10. This oil is thrown radially outward by centrifugal force as it strikes the first spur gear 26 thus lubricating not only the first spur gear 26 but also the second spur gear 42. The oil then flows downwardly due to gravity to a reservoir 68 formed in the base of the housing 24. Preferably a small dam 70 in the reservoir retains a predetermined level of oil within the reservoir 68. Oil in excess of this predetermined level flows over the dam 70 and returns to the engine oil sump by an appropriate passageway 71. The dam 70 also serves to maintain the predetermined level of oil in the reservoir 68 to provide immediate lubrication of the spur gears 26 and 42 upon engine start up.

Although the hydraulic pump 10 of the present invention has been described as utilizing a pair of meshing spur gears 26 and 42 to provide the driving engagement between the engine drive shaft 16 and the hydraulic pump 46, it should be apparent to those skilled in the art that a chain and sprocket arrangement (not shown) between the drive shaft 16 and the hydraulic pump 46 may be substituted for the meshing spur gears 26 and 42 while remaining within the scope of the present invention.

Provision has been made to accommodate the starting motor because these are commonly mounted to the rear of the engine.

It can thus be seen that the hydraulic pump drive 10 of the present invention provides a simple, inexpensive and yet totally effective means for drivingly connecting a hydraulic pump to the engine drive shaft. Moreover, the drive 10 of the present invention is secured at the rear end of the engine, rather than the front, thus not only conserving engine compartment space at the front of the engine, but also protecting the hydraulic pump and drive from damage in the event of a collision or other type of accident. The pump drive 10 in addition receives adequate lubrication from the engine oil and is virtually maintenance free.

Having described my invention, many modifications thereto will become apparent to those skilled in the art to which it pertains without deviation from the spirit of the invention as defined by the scope of the appended claims.

What is claimed is:

1. A hydraulic pump drive for use in conjunction with an engine having a drive shaft, said pump drive comprising:

a housing secured to the rear of said engine, a driving means rotatably carried by said housing and coaxially secured to said drive shaft, a driven means rotatably carried in said housing so that said driving means rotatably drives said driven means, means for securing a hydraulic pump to said driven means, said housing having a base and a reservoir formed in said base for containing a lubricant, and means for supplying lubricant from said engine to said housing and said housing having a reservoir for containing said lubricant, said last-mentioned means comprises a dam formed in said reservoir and a passageway from one side of the dam to the engine.

2. The pump drive as defined in claim 1, wherein said driving means comprises a first gear and said driven means comprises a second gear which meshingly engages said first gear.

3. The pump drive as defined in claim 2, wherein said first and second gears are spur gears having spaced and parallel axes of rotation.

4. The pump drive as defined in claim 1, and including a fly wheel coaxially secured to said driving means.

5. The pump drive as defined in claim 4, wherein said fly wheel includes a ring gear formed around its outer periphery and wherein said housing includes a mounting portion for mounting a starter motor thereto, said starter motor having a gear which selectively meshingly engages with said ring gear.

6. The pump drive as defined in claim 4, wherein said fly wheel and said driving means are secured to the drive shaft by means of at least one axial bolt member extending through registering bores in said fly wheel and said driving means, said bolt member threadably engaging a threaded bore in said drive shaft.

* * * * *

UNITED STATES PATENT AND TRADEMARK OFFICE

CERTIFICATE OF CORRECTION

PATENT NO. : 4,218,193

DATED : August 19, 1980

INVENTOR(S) : John T. Mehne

Figure 2:
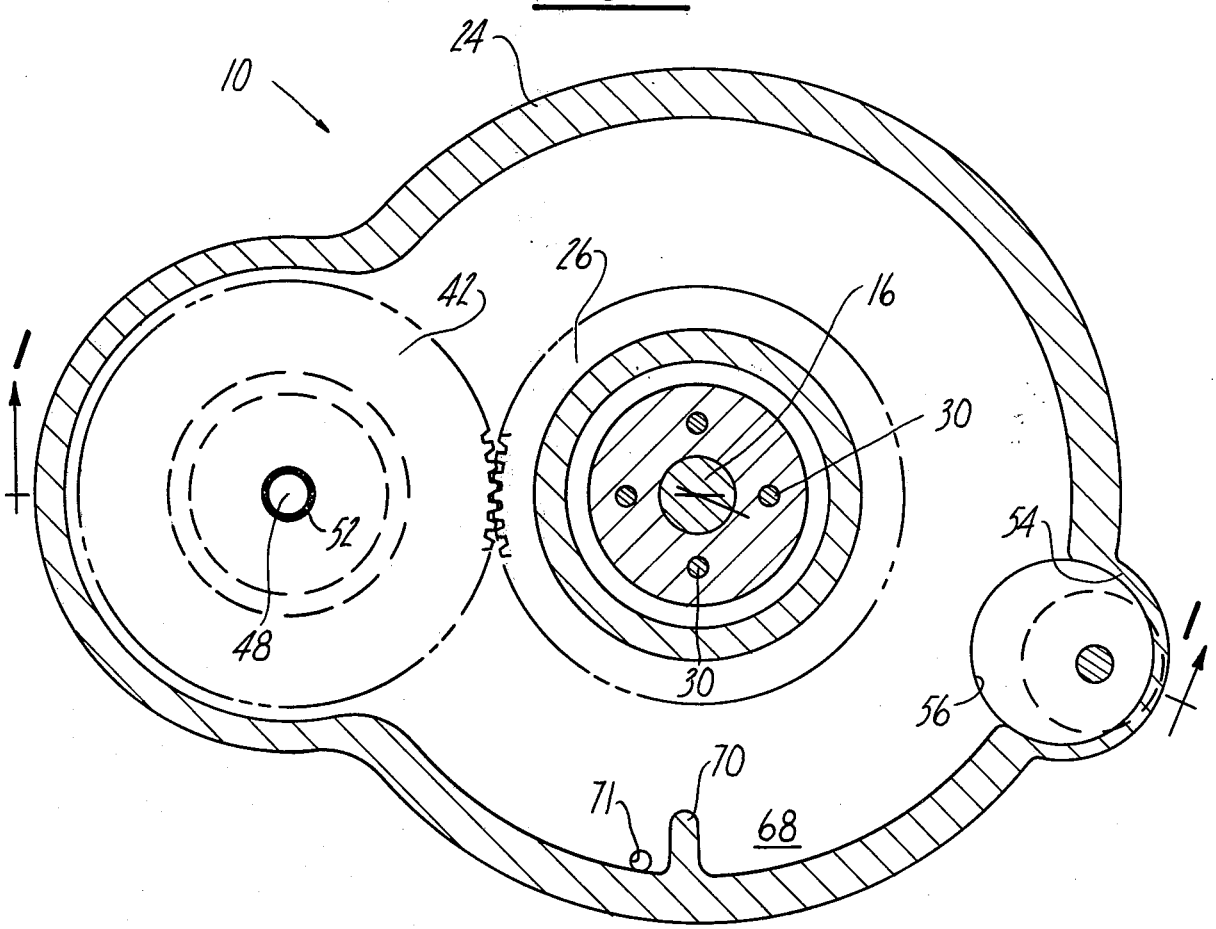
FIG. 2 is a partial cross-sectional view taken substantially along line 2—2 in FIG. 1, with parts removed and broken away for clarity.

It is certified that error appears in the above-identified patent and that said Letters Patent are hereby corrected as shown below:

Column 2, line 20, before "cover" insert --a--;

Column 2, line 35, after "42" insert --with respect--;

Column 2, line 67, after "68" insert --(Fig. 2)--.

Signed and Sealed this

*Ninth* Day of *December 1980*

[SEAL]

*Attest:*

SIDNEY A. DIAMOND

*Attesting Officer*

*Commissioner of Patents and Trademarks*